US008622249B1

(12) United States Patent
Ballentine

(10) Patent No.: US 8,622,249 B1
(45) Date of Patent: Jan. 7, 2014

(54) PERSONAL HYDRATION SYSTEM WITH CONTROL VALVE ASSEMBLY

(75) Inventor: Trent Ballentine, Normal, IL (US)

(73) Assignee: Simple Matter, Inc., Charlotte, NC (US)

( * ) Notice: Subject to any disclaimer, the term of this patent is extended or adjusted under 35 U.S.C. 154(b) by 0 days.

(21) Appl. No.: 13/586,084

(22) Filed: Aug. 15, 2012

Related U.S. Application Data

(63) Continuation-in-part of application No. 12/701,304, filed on Feb. 5, 2010, now Pat. No. 8,544,688.

(60) Provisional application No. 61/527,466, filed on Aug. 25, 2011, provisional application No. 61/154,280, filed on Feb. 20, 2009.

(51) Int. Cl.
*B67D 7/78* (2010.01)

(52) U.S. Cl.
USPC ..... 222/145.5; 222/145.7; 222/325; 222/537; 222/548; 224/148.2; 604/85

(58) Field of Classification Search
USPC ..... 224/148.2; 604/82, 85, 518–519; 222/145.1–145.9, 206–215, 325–327, 222/502–503, 537, 544–564
See application file for complete search history.

(56) References Cited

U.S. PATENT DOCUMENTS

| | | | | |
|---|---|---|---|---|
| 4,820,269 | A * | 4/1989 | Riddell | 604/85 |
| 5,104,158 | A | 4/1992 | Meyer et al. | |
| 5,358,142 | A * | 10/1994 | Holmes | 222/1 |
| D384,731 | S | 10/1997 | Ramacier, Jr. et al. | |
| 6,082,401 | A | 7/2000 | Braun et al. | |
| 7,073,688 | B2 | 7/2006 | Choi et al. | |
| 2004/0118942 | A1 * | 6/2004 | Courtney | 239/302 |
| 2004/0262331 | A1 * | 12/2004 | Woolfson et al. | 222/145.5 |
| 2007/0090135 | A1 * | 4/2007 | Benham | 224/148.2 |
| 2010/0213223 | A1 | 8/2010 | Ballentine | |

* cited by examiner

*Primary Examiner* — Paul R Durand
*Assistant Examiner* — Andrew P Bainbridge
(74) *Attorney, Agent, or Firm* — Andrus, Sceales, Starke, Sawall, LLP

(57) ABSTRACT

A personal hydration system includes a control valve assembly including a valve body provided with a first inlet port fed by a liquid, a second inlet port, and an outlet port for dispensing at least fluid from the first inlet port. The control valve assembly further includes either a flexible and resilient or a non-collapsible reservoir which holds an additive and is mounted to the second inlet port. The first inlet port can be provided with a valve for preventing backflow of the additive from the reservoir, and the reservoir can be provided with a screen for disrupting coagulation of certain additives when mixed with liquid. A valve core is rotatably mounted in the valve body to establish various flow conditions.

9 Claims, 19 Drawing Sheets

PERSONAL HYDRATION SYSTEM WITH CONTROL VALVE ASSEMBLY

CROSS REFERENCE TO RELATED APPLICATIONS

The present application is a continuation in part of U.S. patent application Ser. No. 12/701,304, filed on Feb. 5, 2010 now U.S. Pat. No. 8,544,688 issued Oct. 1, 2013, which is hereby incorporated by reference in its entirety. This application also relates to and claims priority from U.S. Provisional Application Ser. No. 61/527,466, filed on Aug. 25, 2011, and U.S. Provisional Application Ser. No. 61/154,280, filed on Feb. 20, 2009, which are hereby incorporated by reference in their entirety.

FIELD

The present disclosure relates generally to personal hydration systems and, more particularly, pertains to a personal hydration system equipped with a control valve assembly for selectively regulating the flow of various liquids desired by a user of the system.

BACKGROUND

U.S. patent application Ser. No. 12/701,304, filed Feb. 5, 2010, and U.S. Provisional Patent Application No. 61/154,280, filed Feb. 20, 2009, the disclosures of which are hereby incorporated herein by reference in entirety, disclose personal hydration systems comprising a hydration bladder for holding a liquid. A control valve assembly includes a valve body provided with a first inlet port in communication with the liquid in the hydration bladder, a second inlet port and an outlet port for dispensing at least the liquid from the hydration bladder therefrom. The control valve has a reservoir holding an additive and being mounted to the second inlet port of the valve body such that the additive is in communication with the second inlet port. The control valve assembly also includes a valve core mounted within the valve body to establish at least either a single flow condition of the liquid or a mixed flow condition of the liquid and the additive. The valve body and the valve core cooperatively define a liquid circulation arrangement directing flow from the hydration bladder into the reservoir to enable circulation and form a mixture of the liquid and the additive in the reservoir deliverable to the outlet port.

SUMMARY

As described in the incorporated patent applications, the present inventor has recognized deficiencies in prior art personal bladder-type hydration systems. The inventor has recognized that it is desirable to provide a personal hydration system which overcomes the drawbacks of the prior art, and includes a control or mixing valve that selectively controls dispensing of a liquid, such as water or juice, alone or in combination with an additive in solid or liquid form.

The present invention is the product of continued research and development to address these problems.

BRIEF DESCRIPTION OF THE DRAWINGS

FIG. 1 is a plan view of a personal hydration system including one embodiment of a control valve assembly;

FIGS. 2-4 are exemplary views of the personal hydration system and the control valve assembly of FIG. 1 mounted upon a user;

FIG. 5 is an exploded perspective view of the control valve assembly including a reservoir holding an additive as shown in FIG. 1;

FIG. 6 is a perspective view of the assembled control valve assembly with the reservoir shown in FIG. 5 in a single flow condition to provide the user with a liquid only;

FIG. 7 is a perspective view of the assembled control valve assembly with the reservoir shown in FIG. 5 in a mixed flow condition to provide an additive mixed with the liquid;

FIG. 8 is a cross sectional view of a tab and dimple arrangement provided between a valve core and a valve body of the control valve assembly of FIG. 1;

FIG. 9 is a longitudinal sectional view of the control valve assembly and reservoir of FIG. 1 in the single flow condition allowing only liquid flow;

FIG. 10 is a longitudinal sectional view of the control valve assembly and reservoir of FIG. 1 in the mixed flow condition allowing a mixture of liquid and additive flow;

FIG. 11 is a view similar to FIG. 5 showing another embodiment of the control valve assembly;

FIG. 12 is a perspective view of a valve core used in the control valve assembly of FIG. 11;

FIG. 13 is a view similar to FIG. 12 showing the valve core rotated 90';

FIG. 14 is a longitudinal view of the control valve assembly of FIG. 11 in a no flow condition;

FIG. 15 is a longitudinal sectional view of the control valve assembly of FIG. 11 in a single flow condition allowing only liquid flow; and FIG. 16 is a longitudinal sectional view of FIG. 11 in a mixed flow condition allowing a mixture of liquid and additive flow.

FIGS. 17 and 18 are front and rear perspective views of another embodiment of a control valve assembly;

FIG. 19 is a side sectional view of the embodiment shown in FIGS. 17 and 18;

FIG. 20 is a side sectional view of the embodiment shown in FIGS. 17 and 18, showing flow through the control valve assembly in a mixed flow condition;

FIG. 21 is a side sectional view of the embodiment shown in FIGS. 17 and 18, showing compression of an additive reservoir and flow through the control valve assembly in a mixed flow condition;

FIG. 22 is a perspective view of another embodiment of a control valve assembly;

FIG. 23 is a side sectional view of the embodiment shown in FIG. 22, showing the control valve assembly in a mixed flow condition;

FIG. 24 is a side sectional view of another embodiment of the control valve assembly in a single flow condition;

FIG. 25 is a side sectional view of the embodiment shown in FIG. 24 in a mixed flow condition;

FIG. 26 is a perspective view of another embodiment of the control valve assembly; and FIG. 27 is a side sectional view of the embodiment shown in FIG. 26, showing the control valve assembly in a mixed flow condition.

DETAILED DESCRIPTION

The following description regarding FIGS. 1-16 is taken from the incorporated U.S. patent application Ser. No. 12/701,304.

Figure 1:
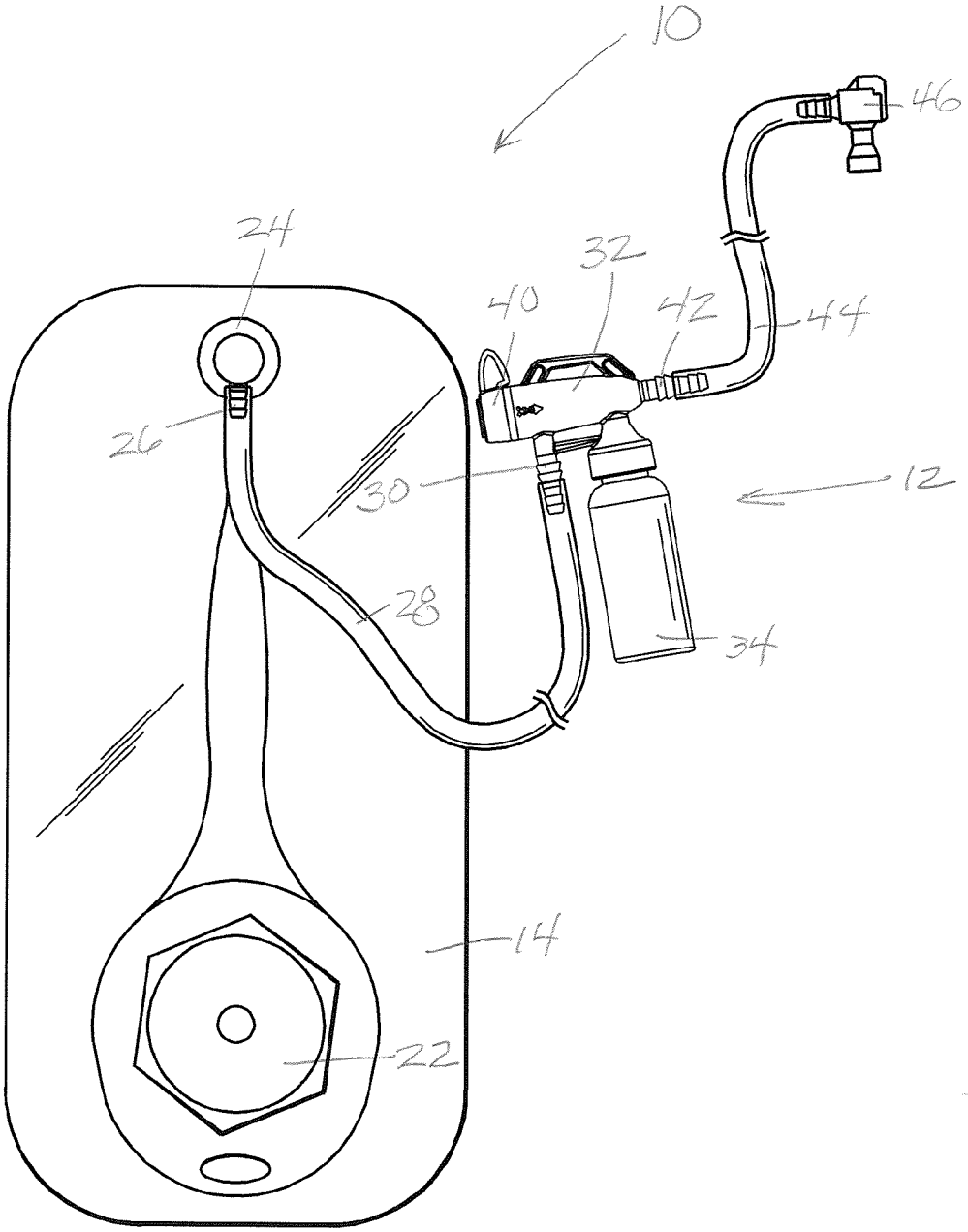
FIGS. 1-16 are taken from U.S. patent application Ser. No. 12/701,304; specifically.

Referring now to the drawings, FIG. 1 illustrates a personal hydration system 10 for storing liquid (such as water, sports drinks, juices, etc.) and features a control valve assembly 12 for selectively controlling the flow of liquid from the system 10.

Figure 5:
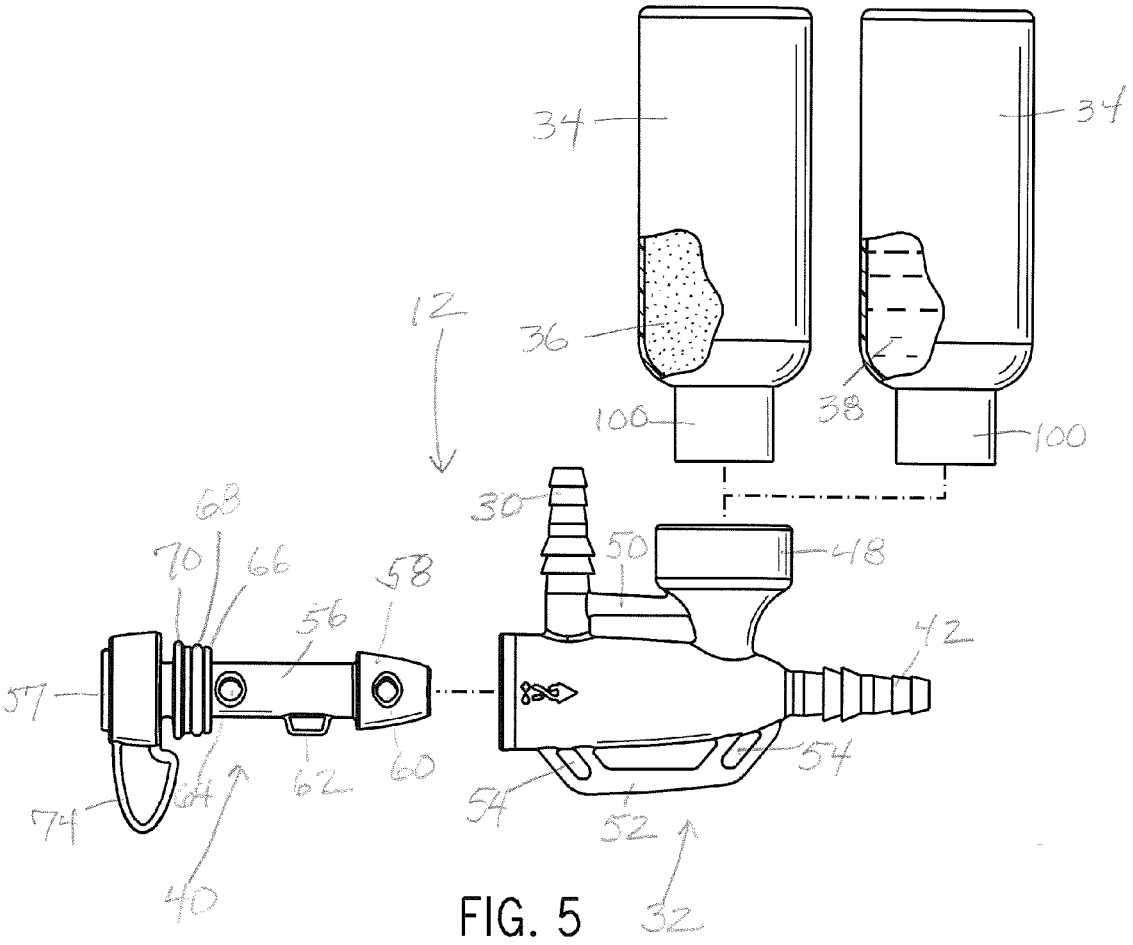

Personal hydration system 10 includes a flexible and expandable bladder 14 which is typically housed in a carrying device 16 (FIG. 3) that is conveniently worn on the back of a user U and supported by shoulder straps 18 and a cross strap 20. The bladder 14 is provided with a fill opening having a cap 22, which may be opened and closed to fill, empty or clean the bladder 14. Bladder 14 also has an outlet 24 equipped with a first tubular barbed adapter 26 onto which one end of a typically transparent, flexible supply hose 28 is removably mounted. The other end of supply hose 28 is removably secured to a second barbed tubular adapter 30 extending generally perpendicularly from a tubular body 32 of the control valve assembly 12. A reservoir 34 taking the form of a non-collapsible, generally rigid and refillable plastic bottle is removably secured to the valve body 32 and is designed to hold an additive typically used to provide an energy and/or nutritional boost to the user of the hydration system 10. Such additive is typically in the form of a powder as shown at 36 (FIG. 5) or a gel 38 (FIG. 5). Many different sources and brands of powder, liquid and gel additives may be used in the reservoir 34.

The valve body 32 has an open end and is designed to receive a removable and rotatable valve control member or core 40. The valve body 32 also has a third barbed tubular adapter 42 which is removably attached to one end of a normally transparent delivery hose 44 at a forward end thereof. The delivery hose 44 forms a drinking tube to enable fluid to be withdrawn from bladder 14. The other end of the delivery hose 44 is provided with a bite or mouth-actuated valve 46. The bite valve 46 is selectively deformed from a position in which liquid regulated by control valve assembly 12 is prevented from being dispensed to a dispensing position in which the user U by oral suction may draw liquid from the bladder 14 when the user U compresses the mouth piece 46 with one's teeth or lips.

Referring now FIG. 5, the valve body 32 is provided with a reservoir receiver 48 spaced from the tubular adapter 30 for receiving and removably mounting the reservoir 34 at a substantially 90° orientation with respect to the valve body 32. A solid bar 50 interconnects tubular adapter 30 and reservoir receiver 48, and may be utilized with an appropriate attachment device such as a clip or tie to position the control valve assembly 12 on the straps 18 of the carrying device 16 holding the hydration bladder 14. In addition, the valve body 32 is formed with a retaining arm 52 opposite the adapter 30 and reservoir receiver 48. The retaining arm 52 creates one or more openings 54 for receiving an attachment device similarly used to fasten the control valve assembly 12 on the carrier straps 18 as will be further described below.

The valve core 40 as seen in FIG. 5, has an elongated tubular spool portion 56 provided with a bulbous front end 58 that is generally frustonically shaped and formed transversely therethrough with a first valve core port 60. Rearwardly of the front end 58, the spool portion 56 is formed with a tab 62 extending therefrom and includes a second valve core port 64 formed transversely therethrough. The spool portion 56 is also constructed with a grooved seal holder 66 that extends radially outwardly from an outer surface of the spool portion 56, and retains a sealing device such as an O-ring 68 thereon. A valve core retaining element 70 further extends radially from the spool portion 56, and has an outer diameter larger than that of the seal holder 66 to further retain O-ring 68 in position on a valve core 40. A cap 72 is integrally configured with a handle 74 and defines a rearward end of the spool portion 56.

Figure 9:
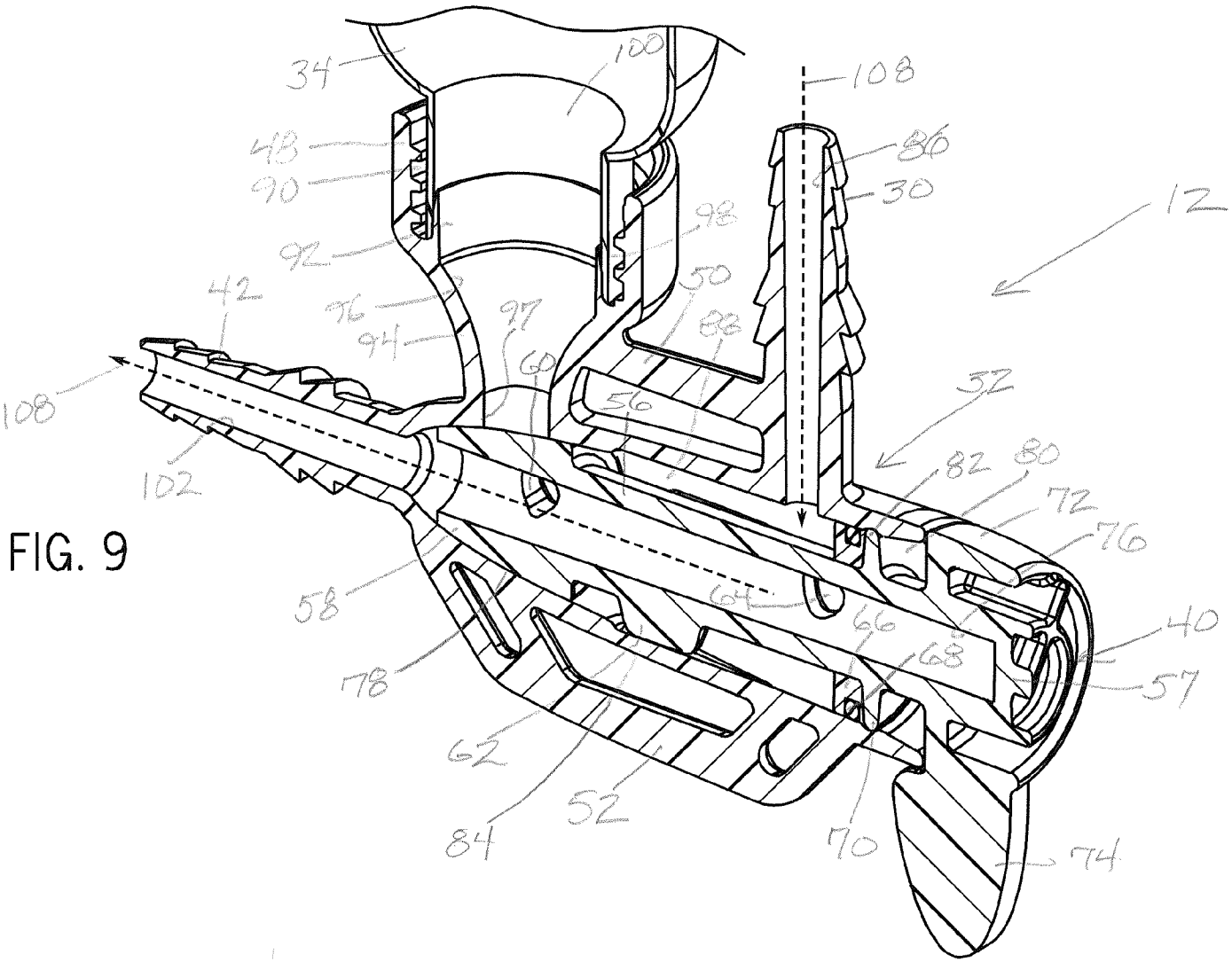
Figure 10:
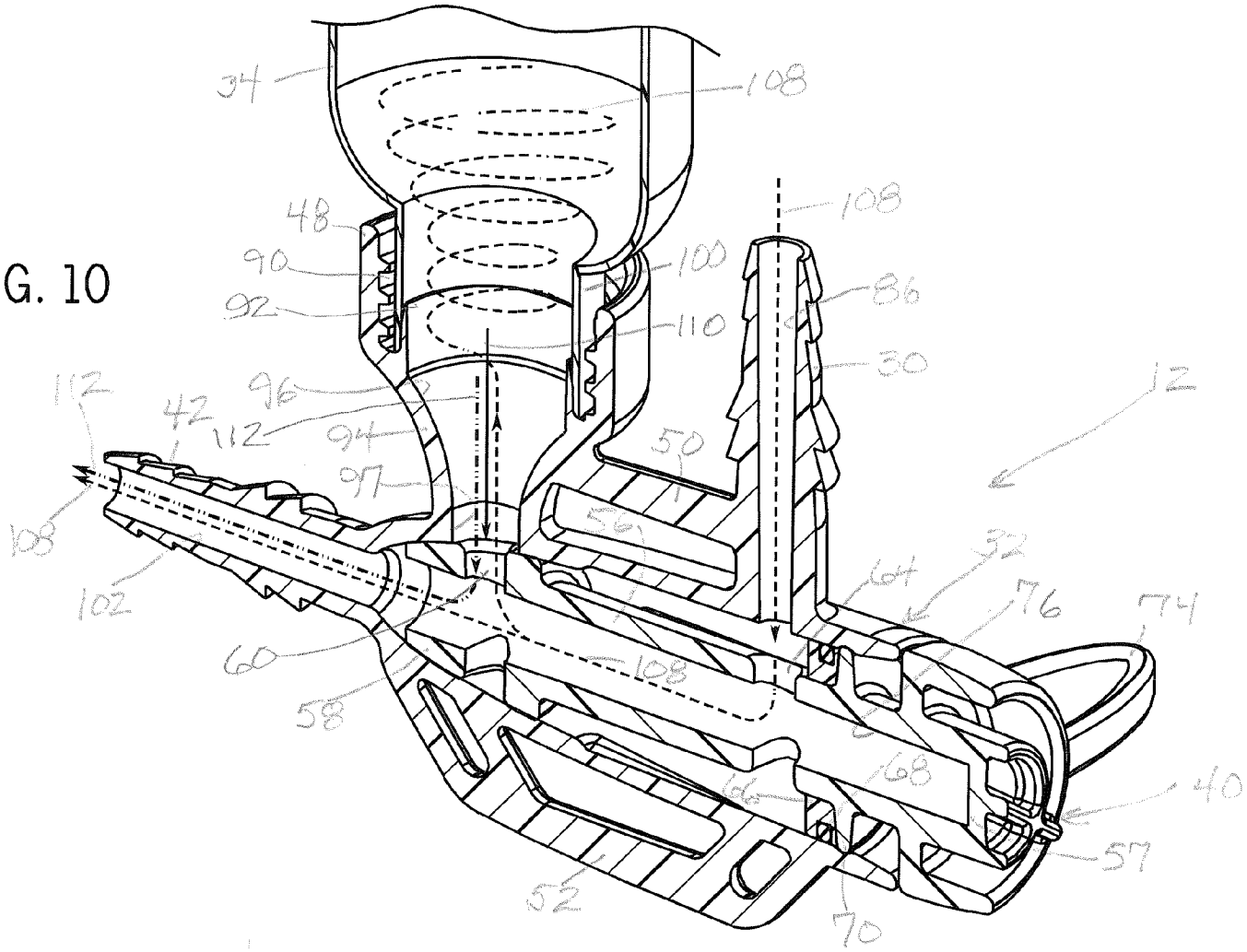
Figure 11:
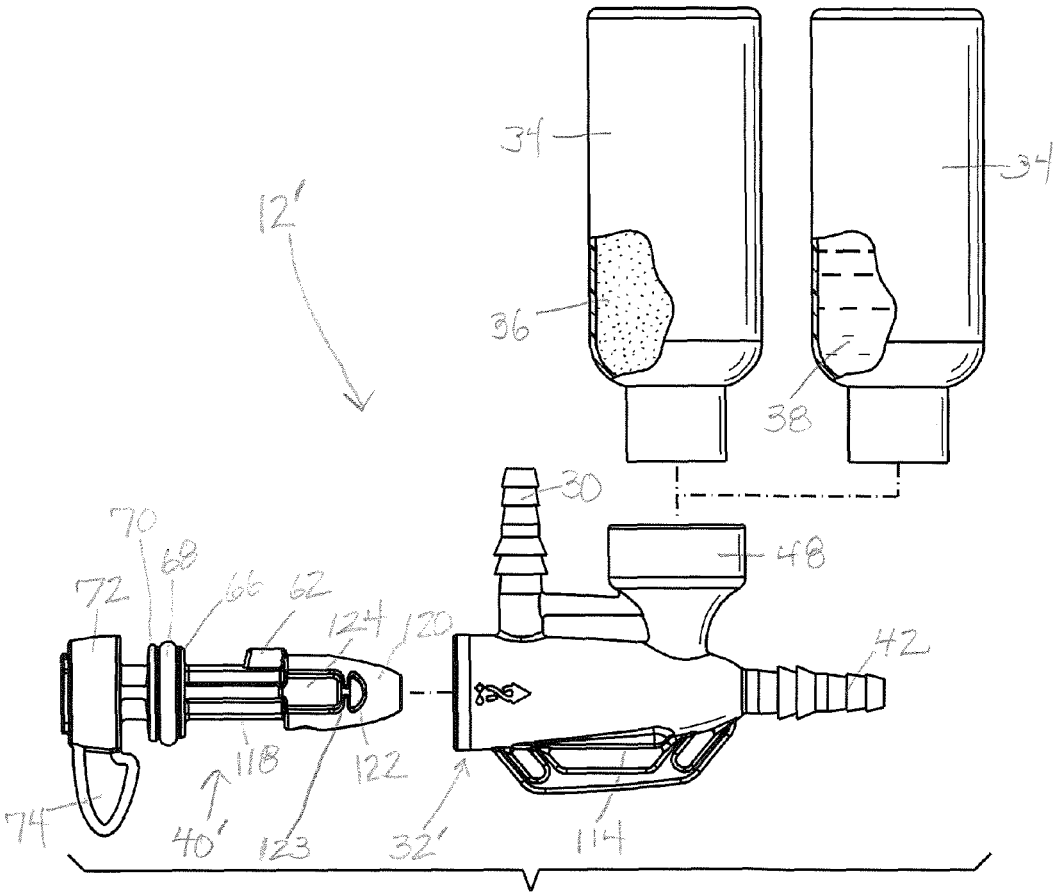
Figure 12:
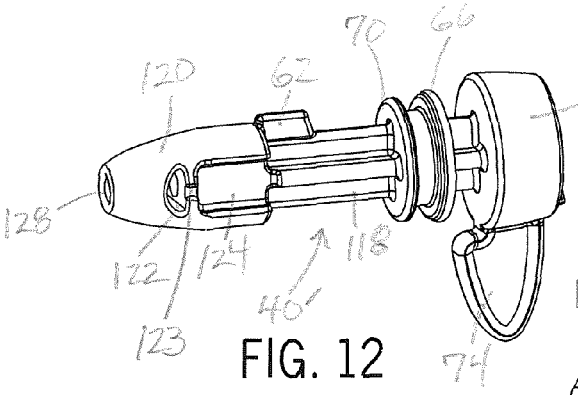
Figure 13:
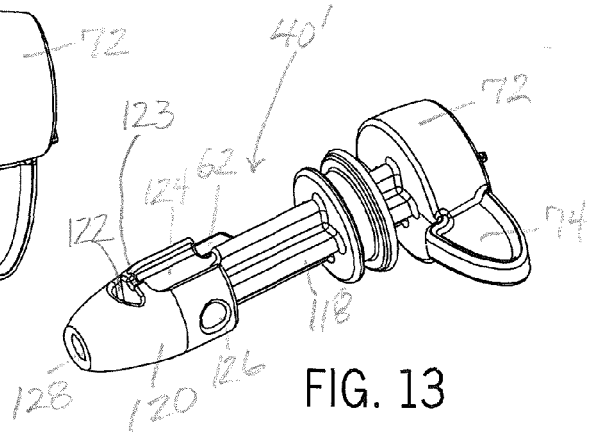

Referring to FIGS. 5, 9 and 10, the spool portion 56 has an internal chamber 76 extending longitudinally therethrough. The chamber 76 is closed at a rearward end 57 thereof, open at a forward end 58 thereof, and communicates with the valve core ports 60 and 64. The valve core ports 60 and 64 and the chamber 76 collectively define liquid passageways for selectively conducting liquid flow through the control valve assembly 12 as will be more closely understood hereafter.

The valve body 32 is formed with an internal wall 78 defining a bore 80 and having a annular groove 82 for slidably receiving and retaining the valve core 40. Sliding of the valve core 40 into the bore 80 enables the retaining element 70 to snap into the wall 78 so as to permit rotation of the valve core 40, but prevent axial movement of the valve core port 60 relative to the valve body 32. At the same time, the O-ring 68 seals tightly against the internal wall 78 of the valve body 32. As seen best in FIG. 8, the internal wall 78 is formed with a series of spaced apart dimples 84 each of which is engageable with the tab 62 on the rotatable valve core 40 to precisely position the handle 74 relative to the valve body 32. The dimples 84 and the tabs 62 serve as a tactile indicator for selection of incremental positions of the rotatable valve core 40 within the valve body 32.

The tubular adapter 30 defines a first inlet port 86 which lies in communication with the water or other liquid in hydration bladder 14. The inlet port 86 also communicates with an axially extending recess 88 lying between the internal wall 78 of the valve body 32 and the outer surface of spool portion 56, and substantially surrounding the spool portion 56 between the front end 58 thereof and the seal holder 66. The reservoir receiver 48 has an internally threaded mouth 90, a sealing ring 92, and a narrowed portion 94 which defines a second inlet port 96. The narrowed portion 94 is provided with an opening 97 which is selectively aligned with the valve core port 60. External threads 98 on a neck 100 of the reservoir 34 are screwthreaded into the threaded mouth 90 such that an inner surface of the neck 100 is sealed with ring 92. With this construction, additive 36 or 38 in the reservoir 34 communicates with the second inlet port 96 which, in turn, may be placed in communication with valve core ports 60, 64 and chamber 76 upon selective rotation of the valve core 40. The tubular adapter 42 defines an outlet port 102 that provides communication between the chamber 76 and the delivery hose 44 terminating in bite valve 46. The outlet port 102 extends centrally from a forward end of the valve body 32, and is aligned with the chamber 76. A longitudinal axis of the control valve assembly 12 passes through the chamber 76 and outlet port 42. As will be described below, the valve core 40 is rotated within the bore 80 of the valve body 32 to create single flow and mixed flow conditions which will prevent or allow certain flow of liquid from the control valve assembly 12 to delivery hose 44 and bite valve 46.

The control valve assembly 12 is conveniently provided to the user U in the form of a kit or package which includes the valve core 40 assembled in the valve body 32 along with a reservoir 34 which is screwthreadedly attached to the valve body 32 and may be prefilled with liquid, gel or other additives 36 or 38, or may be manually filled by the user. The kit also includes attachment devices such as a tie 104 or band 106 for securing the control valve assembly 12 to the straps 18 of the carrier 16. Other suitable attachment devices may be provided to secure the control valve assembly 12 to the straps 18 of the carrier 16 holding the hydration bladder 14.

Figure 2:
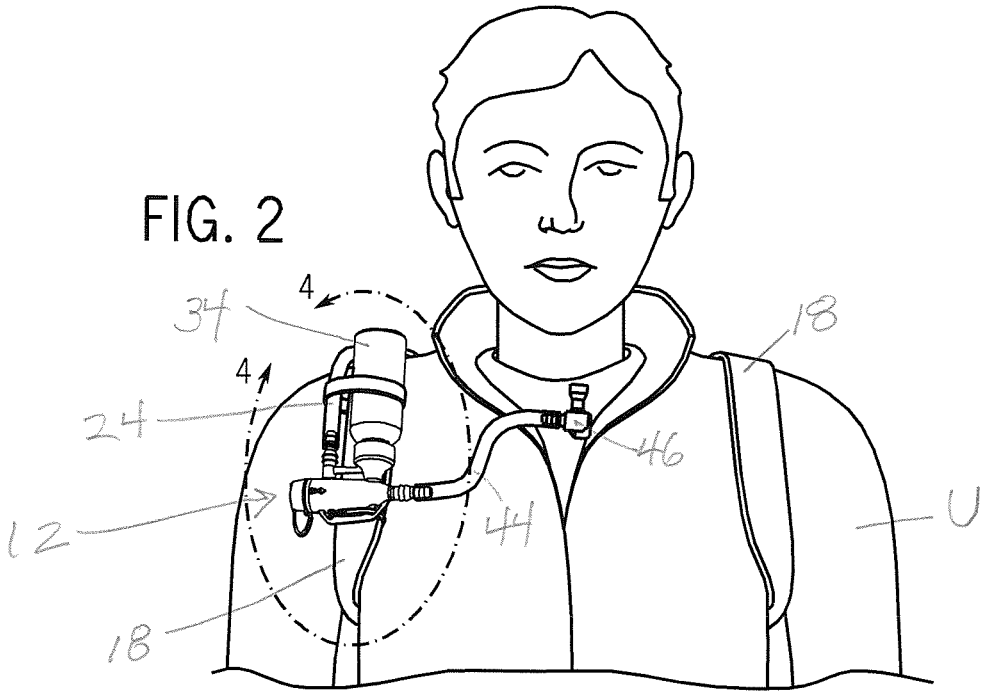
Figure 3:
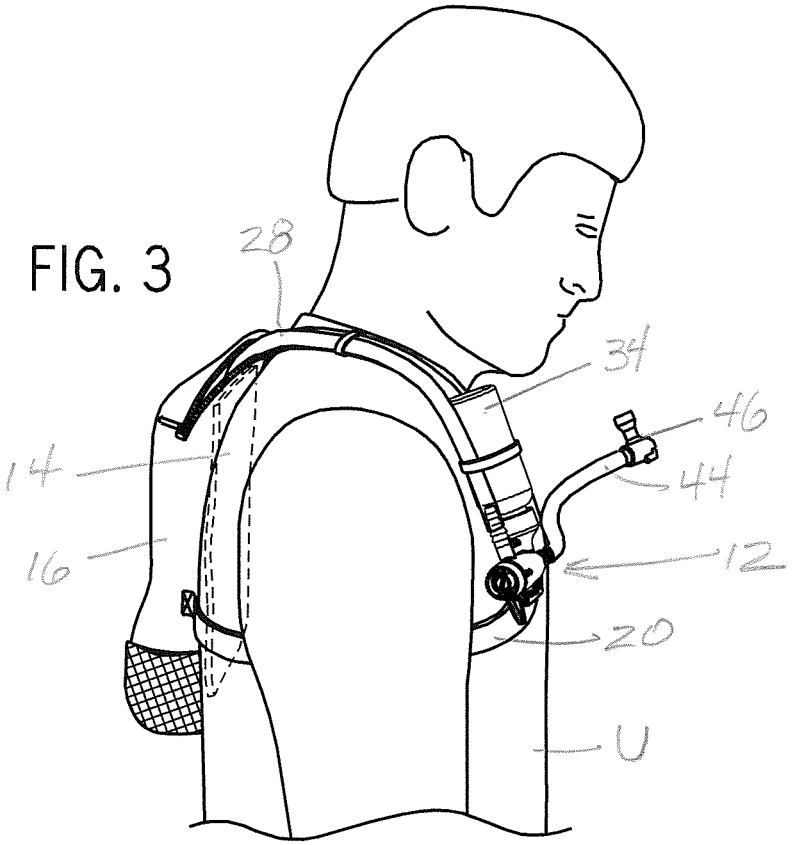
Figure 4:
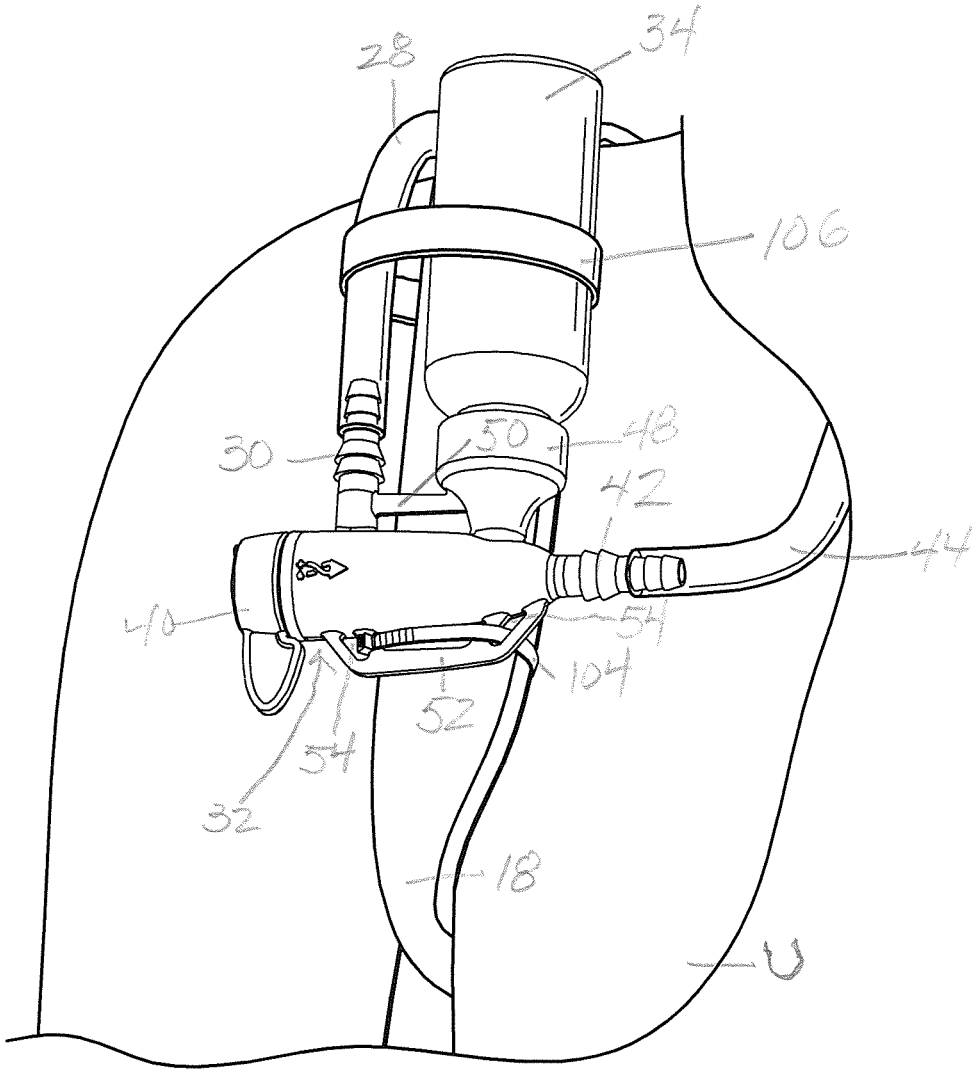

In an exemplary attachment shown in FIGS. 2-4, the tie 104 is passed through openings 54 on retainer arm 52 and secured to one of the over the shoulder straps 18. The band 106 secures the reservoir 34 and the supply hose 28 to the strap 18. In the exemplary attachment shown, the control valve assembly 12 is oriented such that the reservoir 34 filled with additive 36 or 38 is oriented in a generally gravity flow position when the user is in a generally upright position as is the case in a running, walking or biking activity. However, it should be understood that the control valve assembly 12 can also be used if the user U occupies a non-upright position, such as a prone position, as might be assumed during use by military personnel.

Figure 6:
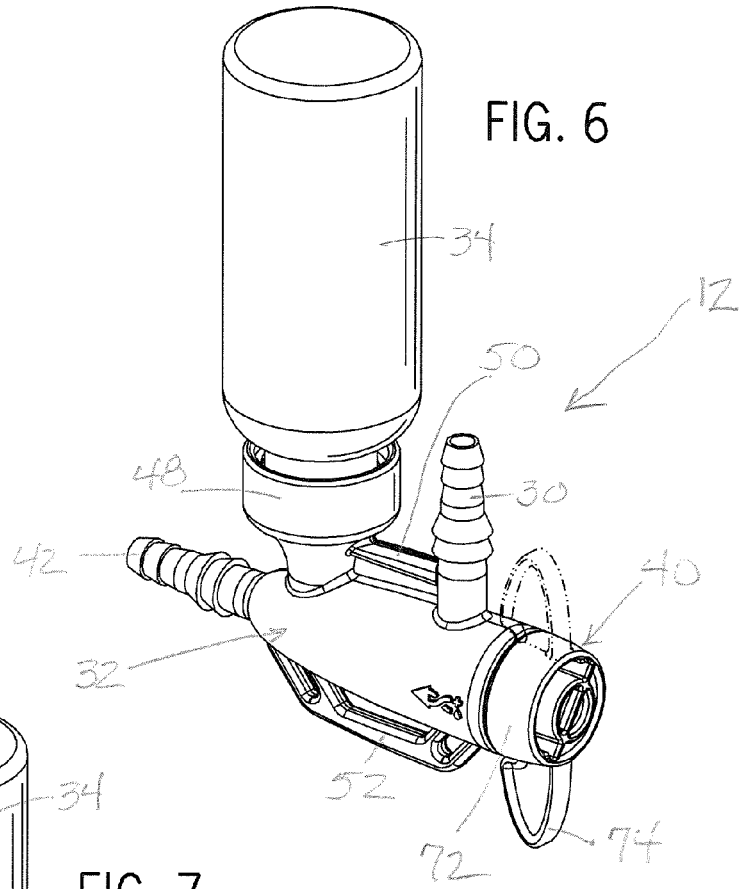

In operation, the valve core 40 is rotatably positioned within the valve body 32 in a single flow condition when the handle 74 is turned to the downwardly extending position shown in FIGS. 4 and 9, or an alternative upwardly extending position shown in phantom lines in FIG. 6. In the single flow condition, alignment of the second inlet port 96 with the valve core port 60 is blocked, but communication among first inlet port 86, valve core port 64, chamber 76 and outlet port 102 is enabled. As a result, no mixing of water or liquid from hydration bladder 14 and additive 36 or 38 in reservoir 34 is permitted, and liquid from hydration bladder 14 only is allowed to flow (as represented by the dotted line 108) through inlet port 86 to outlet port 102 and delivery hose 44 upon a suction force applied at bite valve 46.

It should be appreciated that leakage from the rear of the control valve assembly 12 is prevented by the O-ring 68. Leakage from the forward end of the control valve assembly 12 is prevented by the sealing interface between the bulbous front end 58 of the spool portion 56 and the internal wall 78 of the valve body 32.

Figure 7:
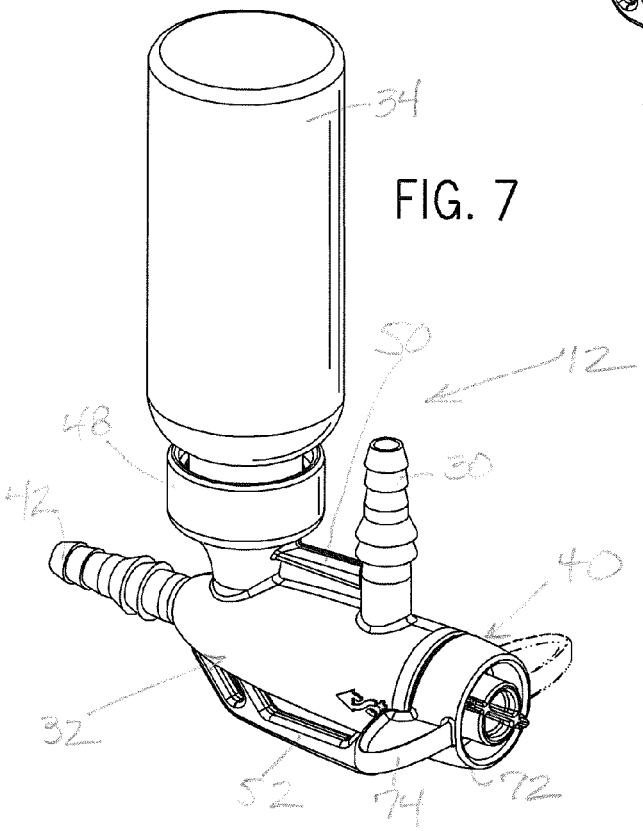
Figure 8:
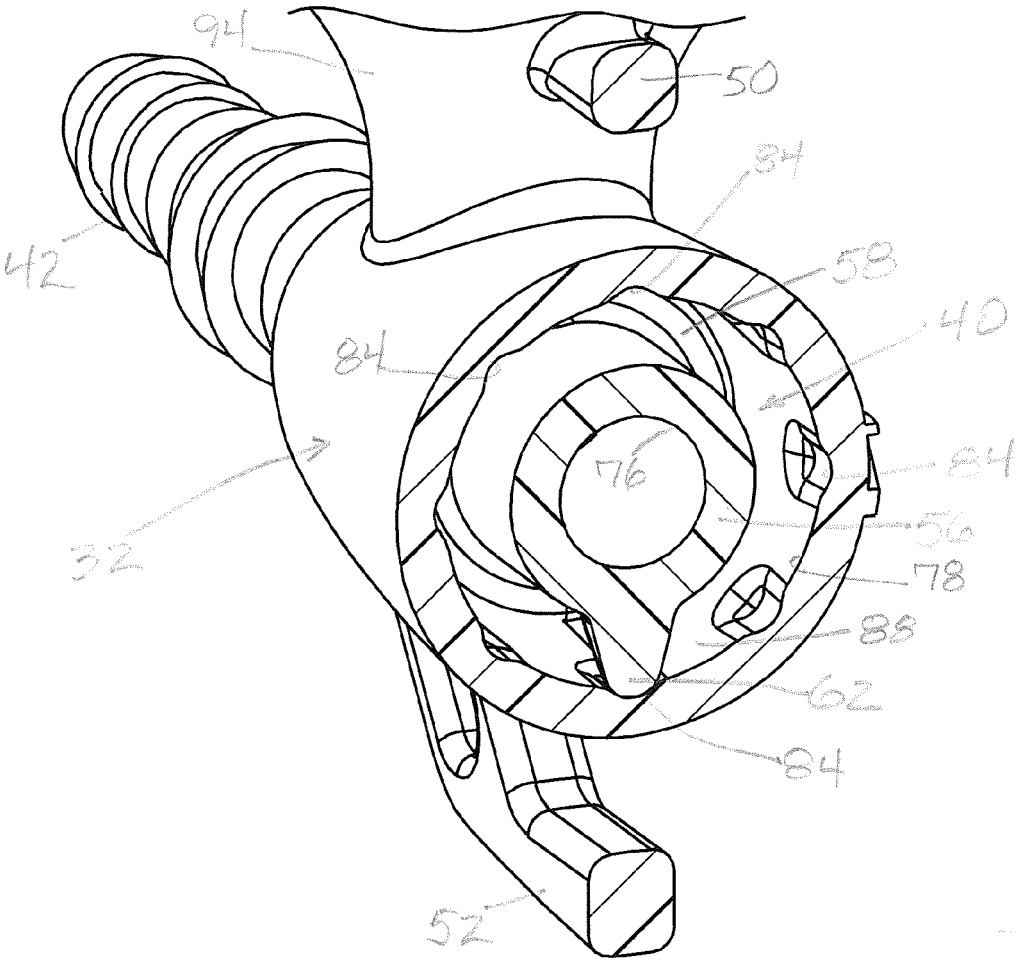

The valve core 40 is rotatably positioned within the valve body 32 in a mixed flow condition when the handle 74 is turned to a laterally extending position shown in FIGS. 7 and 10, or an alternative position shown in phantom lines of FIG. 7. In the mixed flow condition, there is alignment of the second inlet port 96 with the valve core port 60 and simultaneous communication with the chamber 76, the valve core port 64, the first inlet port 86, and the outlet port 102. As a result, liquid from the hydration bladder 14 flows freely through the chamber 76 and directly into opening 97, second inlet port 96 and the reservoir 34, as represented by the dotted line 108, where it forcefully circulates and combines with the additive 36 or 38 represented by the solid line 110. Narrowed portion 94 serves as a flow directing structure for directing liquid flow from hydration bladder 14 into reservoir 34 to facilitate circulation of liquid and additive in the reservoir 34. The valve core port 60, the opening 97 and the narrowed portion 94 are sized and shaped to promote optimum flow of liquid 108 into the reservoir 34 so as to produce an evenly blended liquid mixture 112 of liquid 108 and additive 110 (as represented by line 112) to flow from the outlet port 42. That is, the circulation action of the liquid 108 and the additive 36 or 38 results in a more homogenous liquid mixture 112 which minimizes the presence of liquefied powder clumps when using a dry additive or globs when using a liquid or gel additive. The control valve assembly 12 has been found to provide a substantially consistent liquid mixture product when used with different types of powder, liquid and gel additives.

The control valve assembly 12 is suitably designed so that rotation of the valve core 40 within the valve body 32 between the single flow condition and the mixed flow condition shown in FIGS. 9 and 10 provides the user U with different ratios of liquid from the hydration bladder 14 and gel or powder additive 36 or 38 from the reservoir 34 as desired. The various ratios desired can be correlated with locations of the dimples 84 spaced circumferentially on the internal wall 78 of the valve body 32. Once the additive 36 or 38 is exhausted, the user U unscrews the reservoir 34 from the valve body 34, cleans the interior of the reservoir 34 and refills the reservoir 34 with a similar or different additive than previously used.

It should be appreciated that the control valve 12 does not utilize any check valves in the flow passageways 60, 64, 76 or inlet ports 86, 96, but instead provides a free flow of water or other liquid flow from the hydration bladder 14 (via a suction force) through the port 60 and opening 97 and into reservoir 34 so as to provide the circulation action with the additive 36 or 38 as described above. In addition, the circulation action is facilitated due to the substantially rigid, non-collapsible nature of the reservoir 34 which has an interior mixing space in which water or liquid sucked from the hydration bladder 14 replaces the additive 36 or 38 being mixed or diluted when the valve core 40 is in the mixing position. The control valve assembly 12 can provide a closed system wherein the reservoir 34 does not collapse, and enables circulation action for consistently dissolving a powder additive or liquefying a gel additive. The reservoir 34 can be constructed of substantially rigid material, such as plastic, which will not normally rupture or deform, such as by squeezing or pinching, so as to obstruct or destroy liquid flow.

FIGS. 11-16 illustrate another embodiment of a control valve assembly 12' which is generally similar to the control valve assembly 12 of FIGS. 1-10 except for the following modifications.

Figure 14:
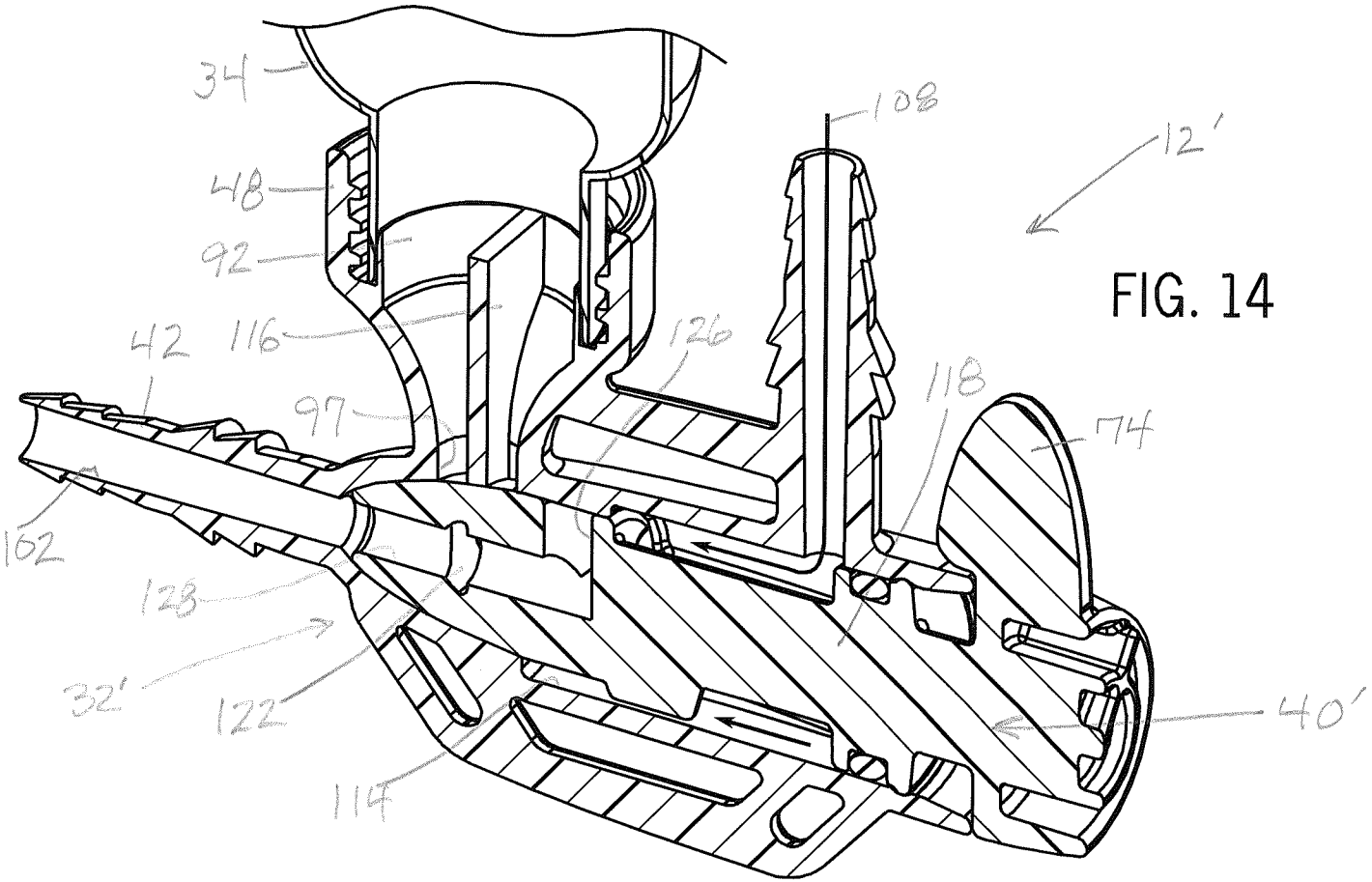
Figure 15:
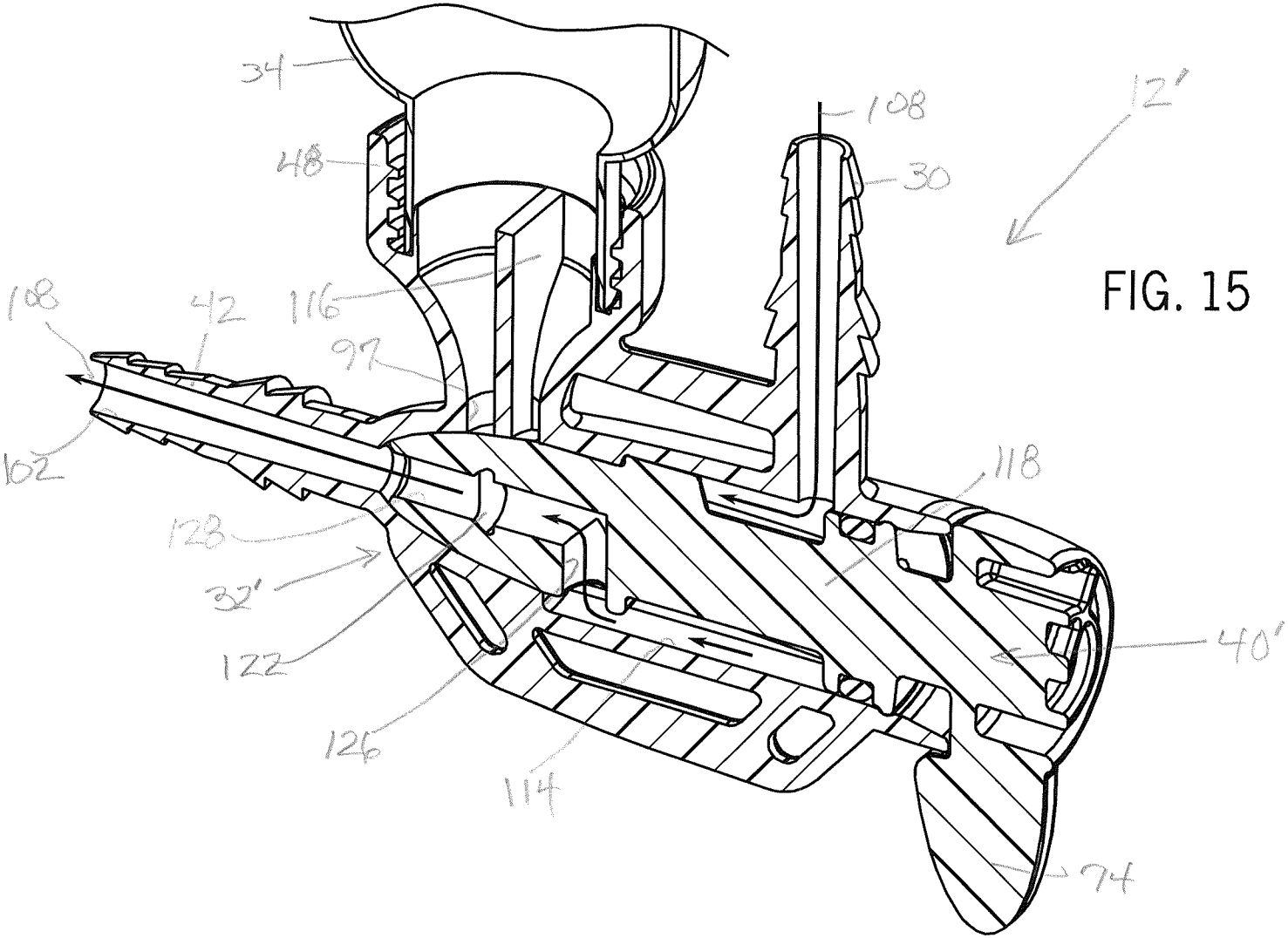
Figure 16:
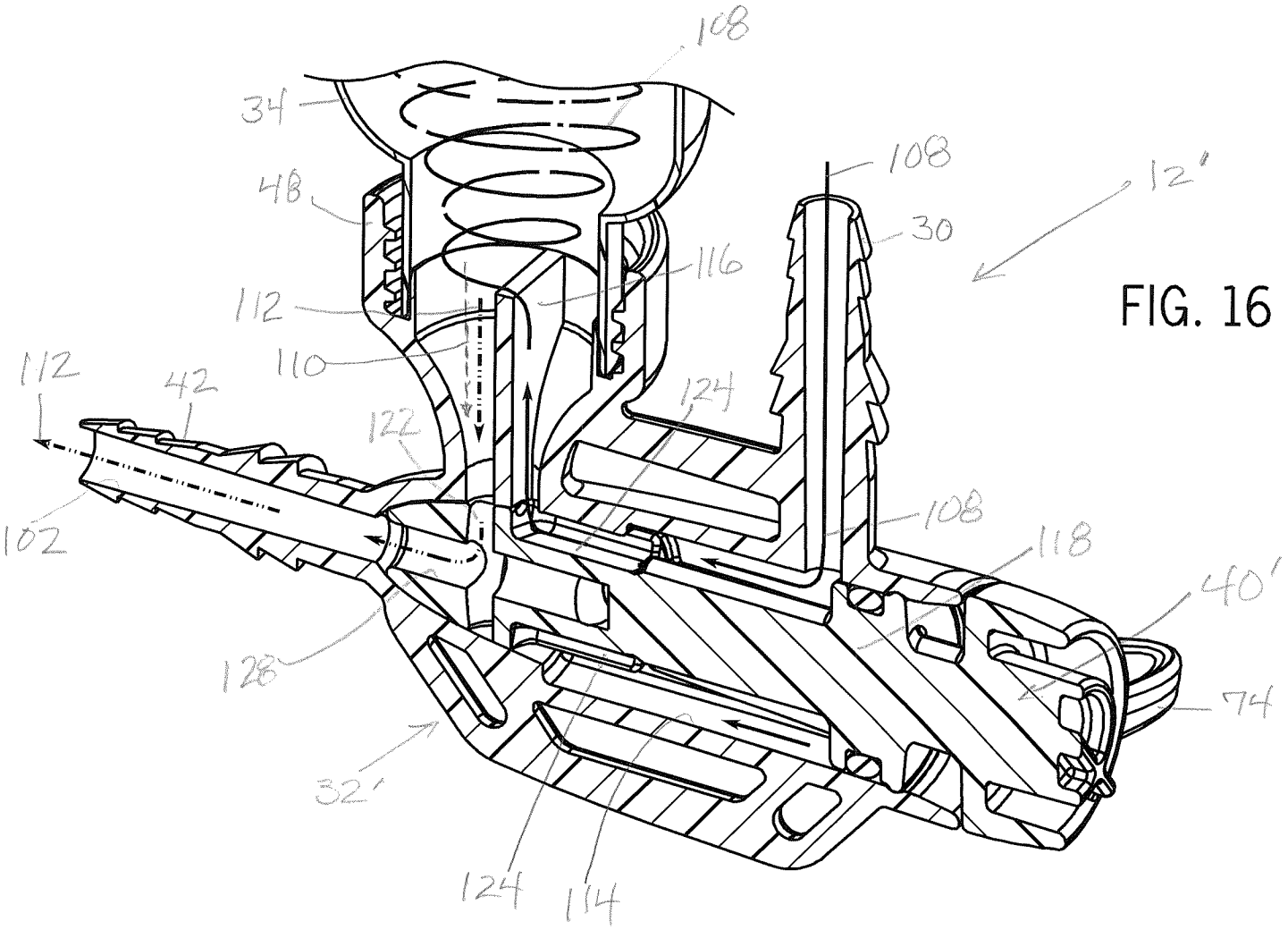
Figure 18:
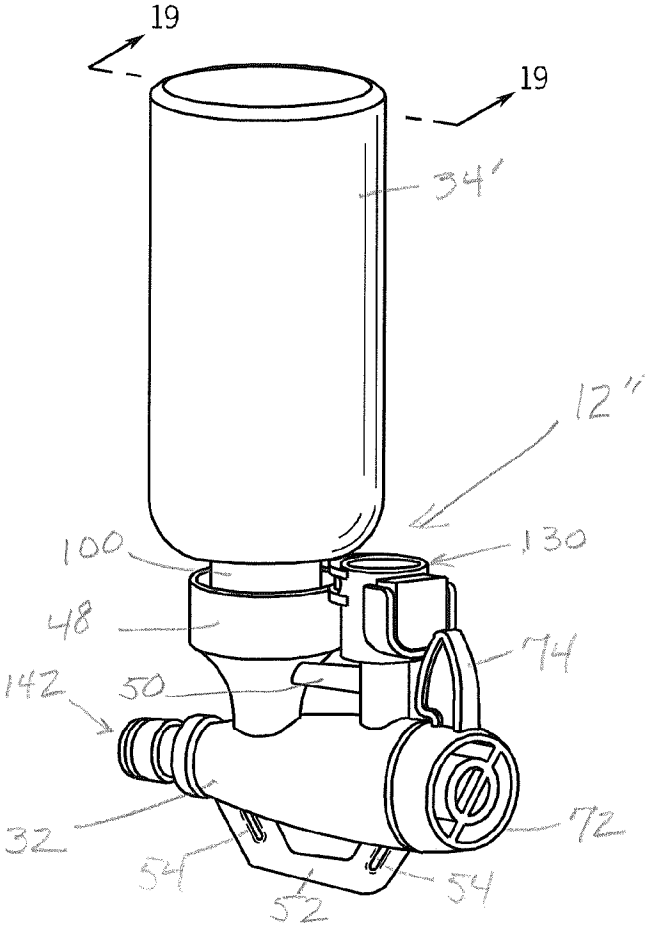
FIGS. 17-27 provide present disclosure for additional and distinct embodiments of a control valve assembly, specifically.
Figure 17:
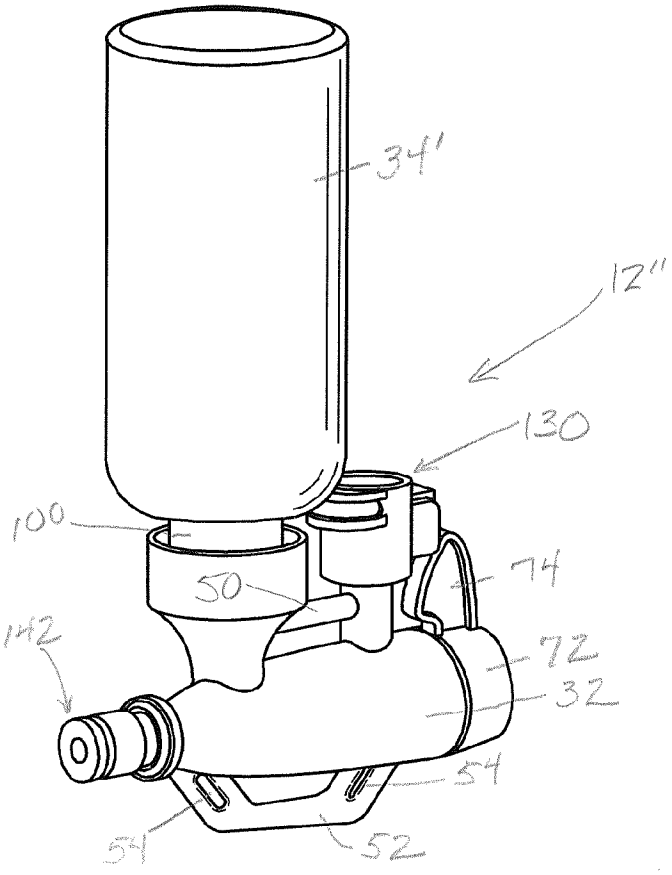
Figure 19A:
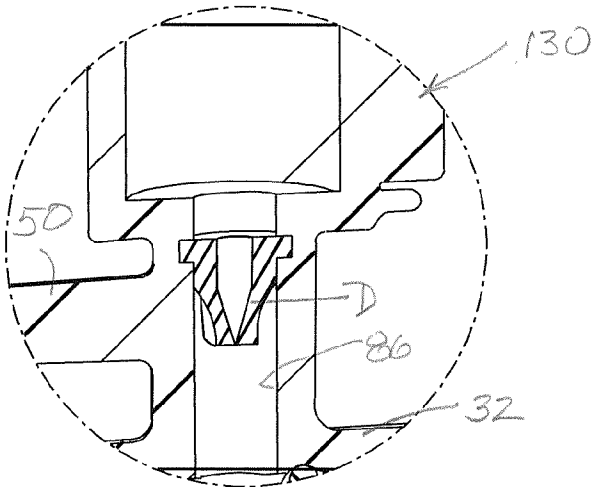
FIG. 19A is a detailed view of a portion of FIG. 19.
Figure 19:
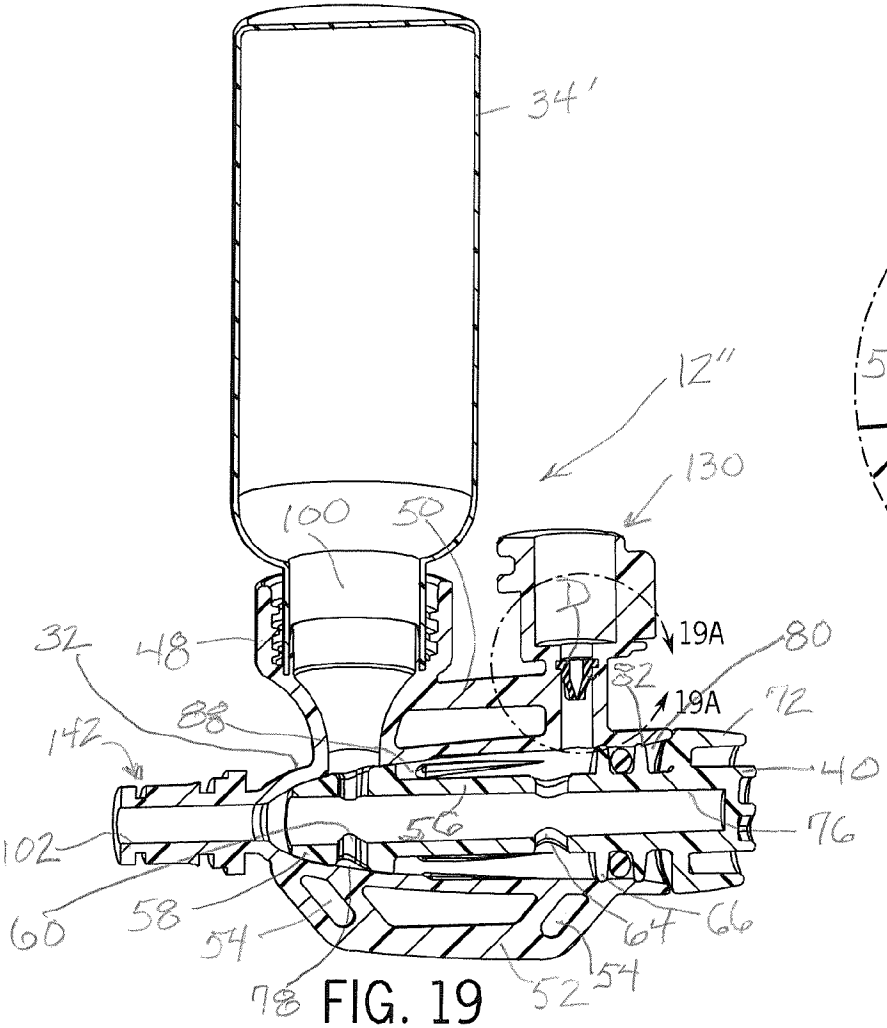
Figure 20A:
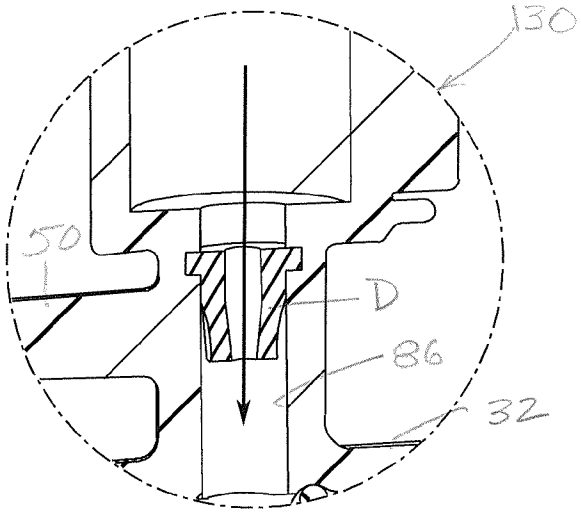
FIG. 20A is a detailed view of a portion of FIG. 20.
Figure 20:
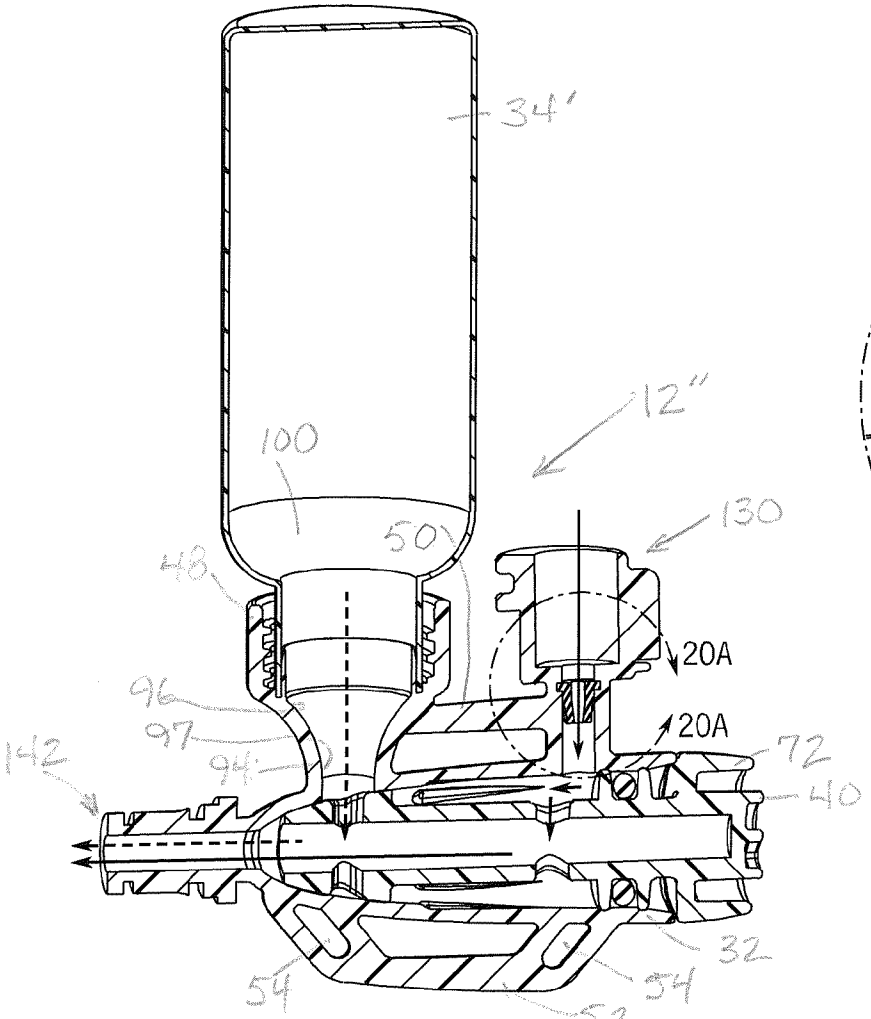

Control valve assembly 12' includes a valve body 32' in which a valve core 40' is rotatably mounted. As seen best in FIG. 11, valve body 32' is formed with a lower belly portion 114 that facilitates a directed flow of water or liquid from the hydration bladder 14 through the control valve assembly 12'. Referring to FIGS. 14-16, reservoir receiver 48 of valve body 32' is provided internally with a vertically extending flow divider 116 which extends from the base of opening 97 up to the sealing ring 92.

Turning to FIGS. 12-16, the valve port 40' has an elongated splined spool portion 118 and a bulbous front end 120 formed therethrough with a valve core port 122 that communicates via a recess 123 with a depression 124. Recesses 123 and depressions 124 are provided on each side of the front end 120. Front end 120 is further formed with another valve core port 126 which is spaced from the depression 124. Valve core ports 122 and 126 are in communication with an internal chamber 128 which extends out of the front end 120 of the control core 40', and communicates with outlet port 102 and valve core 40' mounted inside valve body 32'. Valve core ports 122 and 126, recesses 123, depressions 124 and chamber 128 define liquid passageways for conducting liquid flow through the control valve assembly 12'.

In operation of the control valve assembly 12', the valve core 40' is rotatably mounted within valve body 32' in a no flow condition when the handle 74 is turned to the upwardly extending position as shown in FIG. 14. In the no flow condition, liquid flow from the bladder 14, as represented by solid line 108, may be drawn through inlet port 30 for flow around the spool portion 118, but the rotational position of the valve core 40' prevents any liquid flow 108 from entering valve core port 126, chamber 128 and outlet port 102 as well as opening 97.

When the handle 74 of valve core 40' is rotated to the downwardly extending orientation, as shown in FIG. 15, a single flow condition is established in which liquid flow 108 from the bladder 14 is drawn through inlet port 30, flows around spool portion 118, and is allowed to flow through valve port 126 into chamber 128 and out of outlet port 102. The rotational position of the valve core 40' prevents any liquid flow 108 from entering the opening 97 leading into the reservoir 34 filled with additive 36 or 38.

When the valve core 40' is further rotated to the laterally extending orientation, as shown in FIG. 16, a mixed flow condition is defined. In the mixed flow condition, liquid flow 108 from bladder 14 drawn through the inlet port 30 flows around spool portion 118 and is led into depressions 124 and opening 97 at the bottom of reservoir receiver 48. The liquid flow 108 is then directed along one side of the flow divider 116 so that if forcefully circulates and mixes with the additive 36 or 38 in the reservoir 34 as represented by the dotted line 110. Flow divider 116 and narrowed portion 94 act as a flow directing structure for directing liquid flow from bladder 14 into reservoir 34 to facilitate circulation of liquid and additive in the reservoir 34. The liquid and additive mixture represented by the dotted line 112 flows down the other side of flow divider 116 and exits out chamber 128 and outlet port 102. As the additive 36 or 38 is used, liquid flow 108 continues to replenish the empty space in the reservoir 34 vacated by the additive 36 or 38.

The following description regarding FIGS. 17-21A relate to the present disclosure.

FIGS. 17-21A disclose another embodiment of a control valve assembly 12" for selectively controlling the flow of liquid from the system 10. Many features of the embodiment 12" are similar to or the same as the features of the embodiment shown in FIGS. 5-10. Like reference numbers for the features that are similar to or the same as the embodiment shown in FIGS. 5-10 are used in FIGS. 17-21A.

Figure 21A:
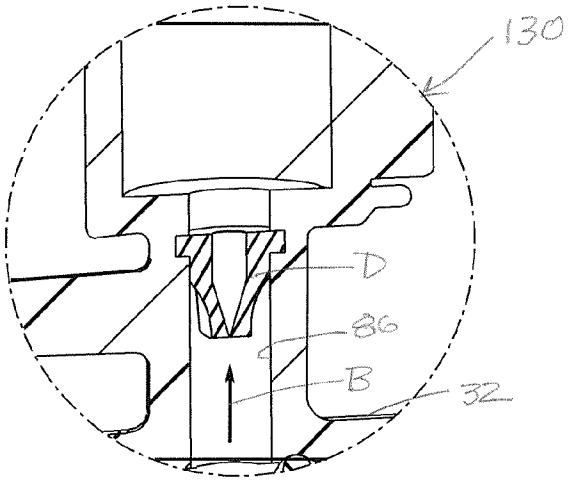
FIG. 21A is a detailed view of a portion of FIG. 21.
Figure 21:
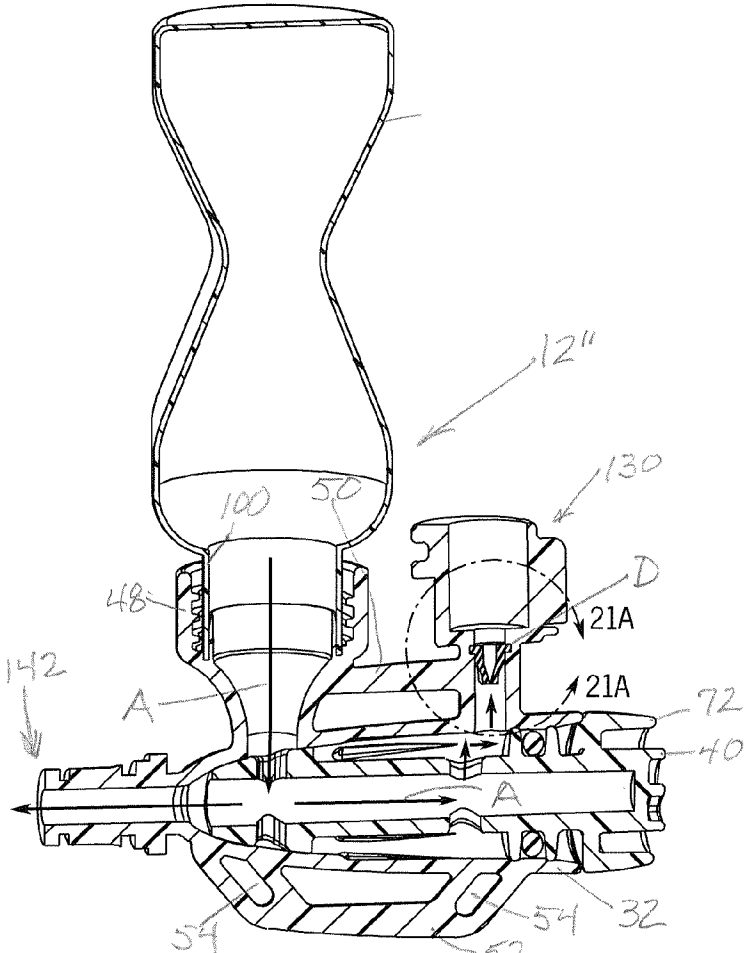
Figure 23:
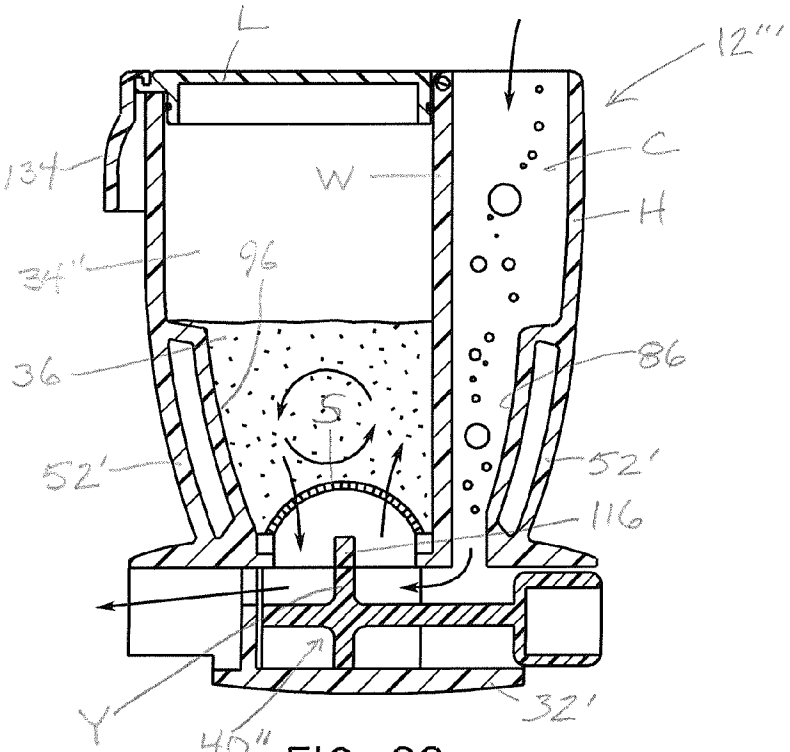
Figure 22:
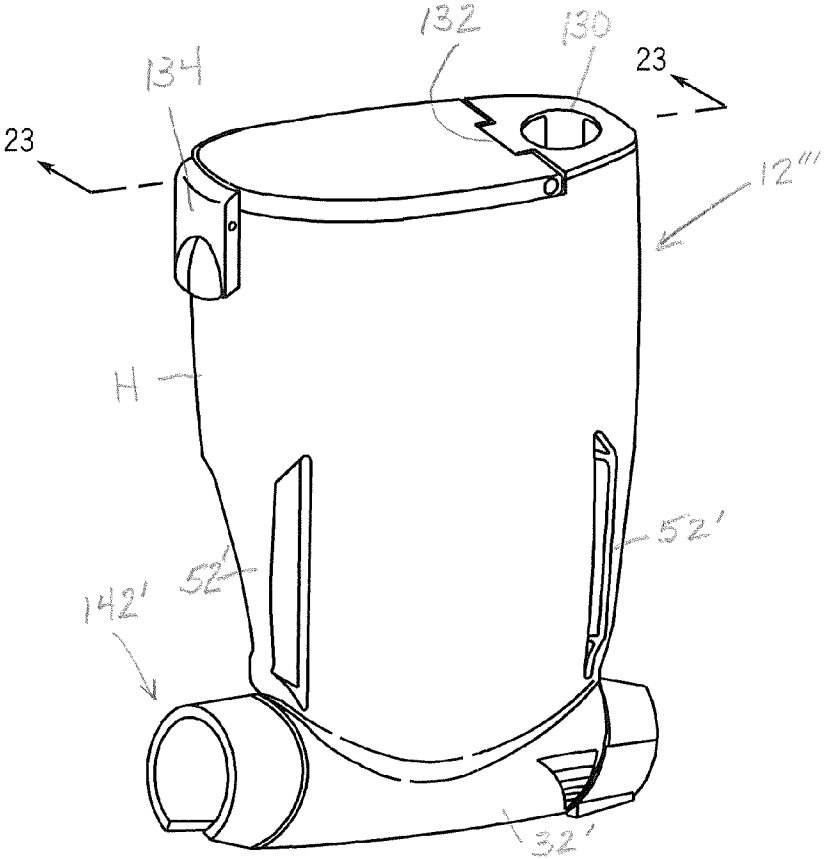

In the example of FIGS. 17-21A, the additive reservoir 34' is constructed of a flexible material such as for example relatively low density plastic so that the reservoir 34' can be manually squeezed from the expanded shape shown in FIGS. 17-20 to the collapsed shape shown in FIG. 21. Collapsing of the reservoir 34' forces additive from inside the reservoir 34' into the valve body 32, as shown at arrows A in FIG. 21 for mixing with fluid that is withdrawn from the bladder 14 via the delivery hose 44, for example via bite valve 46 during oral suction by the user. The low density plastic of the reservoir 34' can be selected to have resiliency so that the reservoir 34' returns to the expanded shape upon being manually released.

The control valve assembly 12" shown in FIGS. 17-21A also includes a quick connect adapter 130 instead of the barbed tubular adapter 30 shown in the embodiment of FIGS. 5-10. The quick connect adapter 130 can be of the type manufactured by Colder Products Company of St. Paul, Minn. See the website www.colder.com for examples of such quick connect adapters. An example of such a quick connect adapter is shown in U.S. Pat. No. 5,104,158, the disclosure of which is hereby incorporated herein by reference in entirety. Additional quick connect adapters could be utilized, such as for example those disclosed in U.S. Pat. No. 6,082,401 and D384,731, the disclosures of which are hereby incorporated herein by reference in entirety. The quick connect adapter 130 is in communication with the inlet port 86, and can thus enable quick connection and disconnection of the supply hose 28 to the body 32 of assembly 12 for delivery of fluid thereto.

An additional quick connect adapter 142 enabling quick connection and disconnection of the delivery hose 44 and related bite or mouth actuated valve 46 is provided instead of the third barbed tubular adapter 42. The quick connect adapter 142 is in communication with the outlet port 102, and can be of the types mentioned herein above.

A duckbill valve D is disposed in the inlet port 86 of valve body 32 and prevents backflow of additive at arrow B (FIG. 21) from the reservoir 34' and body 32 to the adapter 130 and supply hose 28. That is, the duckbill valve D will not allow backflow of additive out of inlet port 86 to supply hose 28.

The assembly 12" thus allows the user U to increase the amount of additive in the mixture dispensed through the delivery hose 44 by squeezing the reservoir 34' and forcing additional additive into the valve body 32. The duckbill valve D advantageously protects the adapter 130 and supply hose 28 from becoming clogged with additive.

Figure 25:
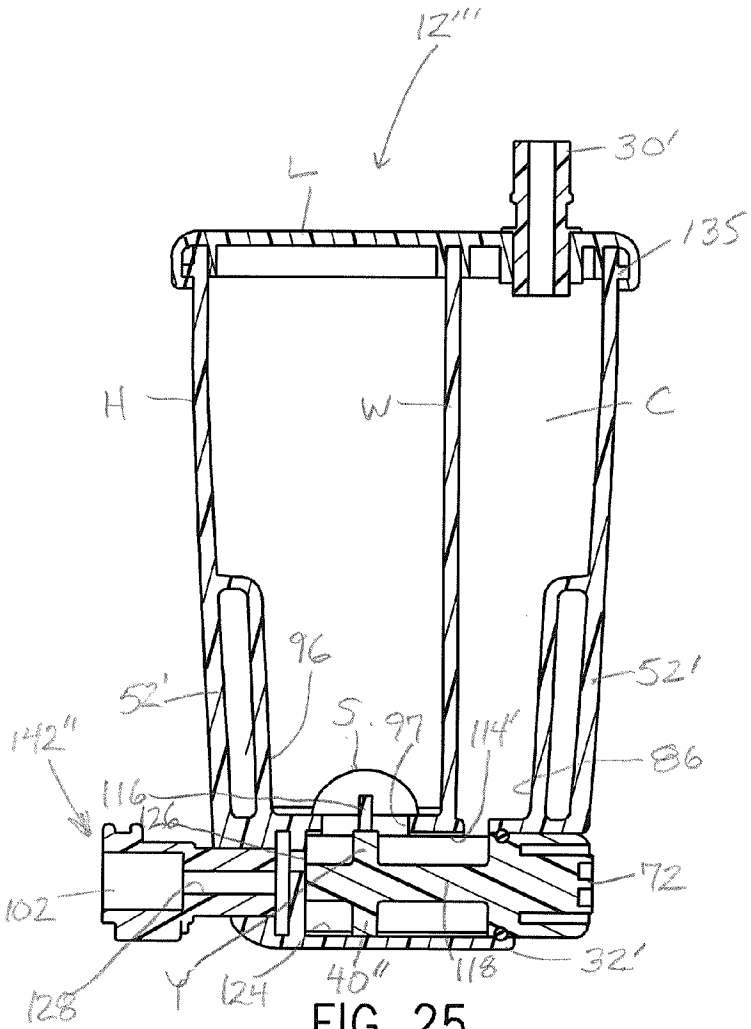
Figure 24:
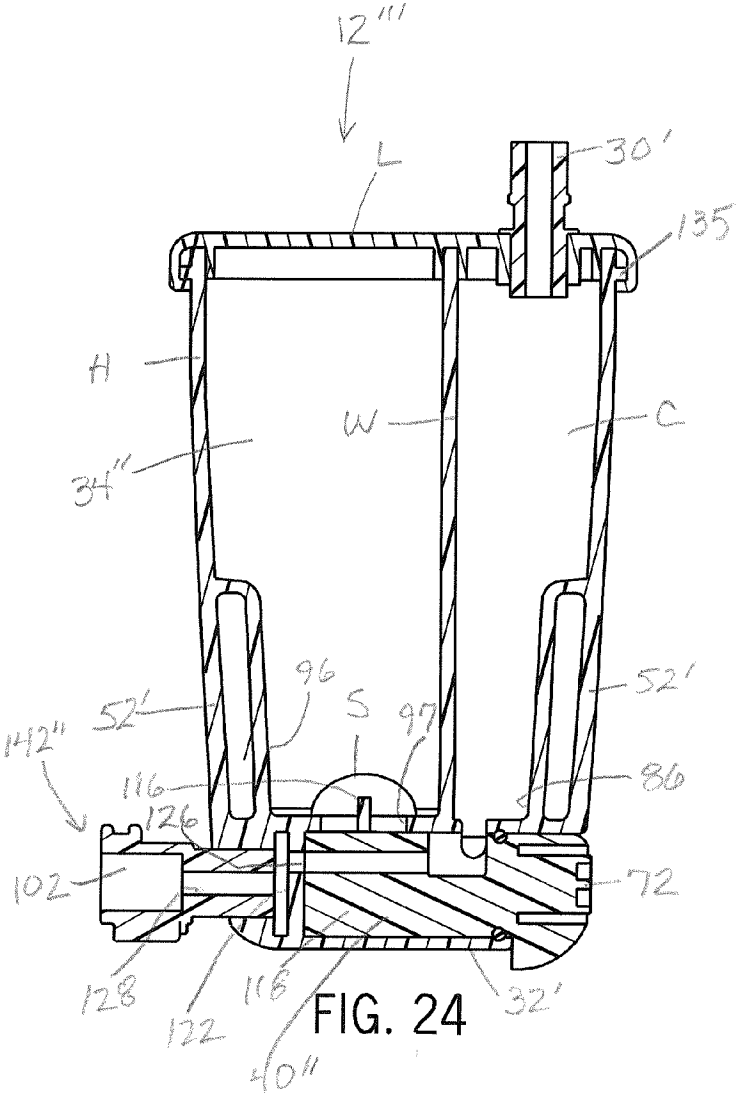
Figure 27:
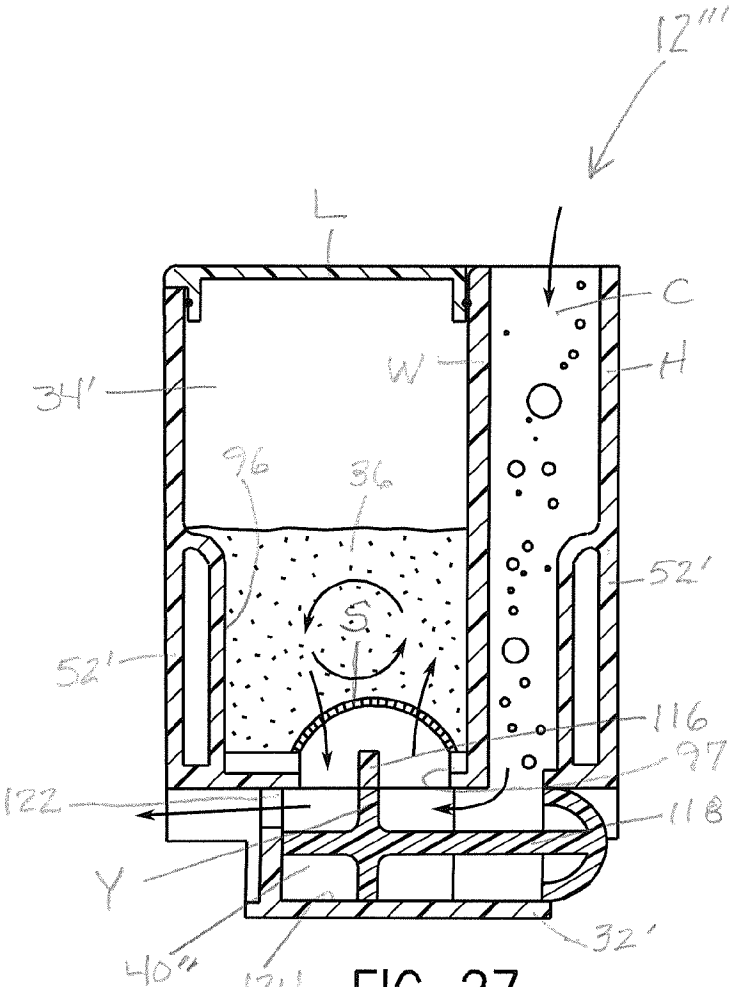
Figure 26:
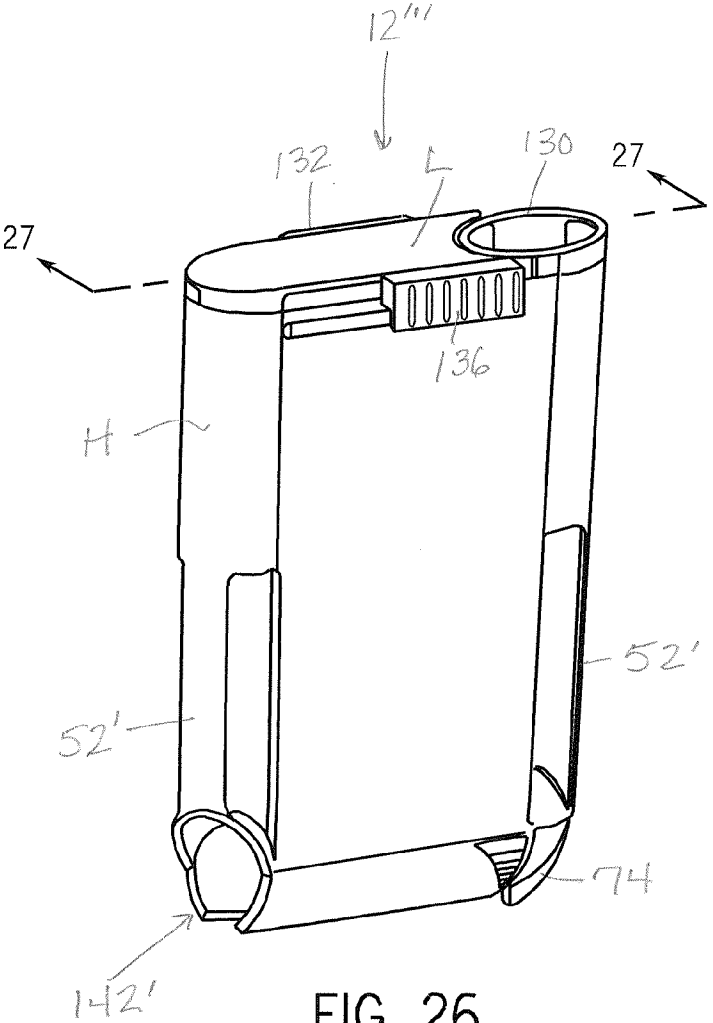

FIGS. 22-27 depict additional embodiments of an assembly 12'". In these embodiments, the reservoir 34" is part of a rigid housing H that is integral with body 32' and also includes a liquid chamber C. The reservoir 34" is separated from the chamber C by a separating wall W. A movable lid L is provided on the reservoir 34". The lid L can be hinged at one end, such as shown at hinge 132 in FIG. 22 and latched at an opposite end by a camming latch 134. Alternately, a snap-fit arrangement 135 for the lid L can be provided, such as shown in FIGS. 24 and 25, and adapter 30' extends upwardly from the lid L. Alternately, a sliding latch arrangement 136, such as is shown in FIGS. 26 and 27 can be provided to lock the lid L in the closed position. In the embodiment of FIGS. 26, 27, the sliding latch arrangement 136 is shown on a front edge of lid L, and the hinge 132 is located at a rear edge of lid L.

An inlet screen S is provided in the lower end of inlet port 96 and the reservoir 34". The screen S in the example shown is dome shaped and extends across the second inlet port 96; however, other configurations can be employed. The purpose of the screen S will be described further herein below.

The control valve assembly 12'" has a valve core 40" similar to the valve core 40' shown in FIGS. 11-16. The valve core 40" includes a flow divider Y that aligns with the flow divider 116 of body 32' when the valve core 40" is rotated into the noted mixed flow condition, see FIGS. 23, 25 and 27. As shown by the arrows in FIGS. 23 and 27, drinking fluid from the chamber C is directed upwardly through the screen S by the flow dividers Y and 116 so as to cause circulation within the reservoir 34", thus disrupting and preventing coagulation of the additive and clearing the screen S from blockage. This is particularly helpful when the additive is a powder-based material. Flow of the liquid and the pore size of the screen S can be configured so as to prevent formation of a certain particle size within the powder-based additive, thus protecting the downstream bite valve 46 from clogging. The top of the flow divider 116 is spaced from the screen S so that liquid flow from chamber C is directed through the entire screen to push additive particles away from screen S until the flow-stimulated particles have broken down in size to pass freely through the screen S. The screen S is replaceable and can have different sized holes and different shapes depending upon the particular type of additive being utilized.

As with the previous embodiments shown in FIGS. 17-21A, adapters and quick connectors such as are shown at 142', 130, and 30' can be utilized to facilitate quick connection of the delivery and supply hoses.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Various alternatives and embodiments are contemplated as being with in the scope of the following claims, particularly pointing out and distinctly claiming the subject matter regarded as the invention.

What is claimed is:

1. A control valve assembly adapted for use with a personal hydration system having a hydration bladder holding a liquid and provided with a supply hose in communication with the liquid, the control valve assembly comprising:

a valve body having a first inlet port fed by a liquid and adapted to be connected to the supply hose, a second inlet port extending from the valve body, the second inlet port being mounted to a reservoir holding an additive therein such that the additive, as well as liquid from the inlet port, is permitted to flow through the second inlet port, and an outlet port adapted to be connected to a delivery hose for dispensing at least liquid from the first inlet port; and a valve core movably mounted in the valve body and having liquid passageways cooperable with the first and second inlets and the outlet port to establish at least either a single flow condition of the liquid or a mixed flow condition of the liquid and the additive deliverable to the outlet port, wherein the reservoir is provided with a screen, and wherein in the mixed flow condition, the valve core enables liquid to flow freely through the first inlet port, the screen and the second inlet port, and be admitted and circulated through the reservoir to produce an anti-clogging mixture of liquid and additive deliverable through the second inlet port to the outlet port.

2. The control valve assembly of claim 1, wherein the valve body and the valve core are provided with flow directing structure for directing liquid flow from the first inlet port through the screen and into the reservoir.

3. The control valve assembly of claim 2, wherein the screen has a dome shape which projects upwardly into the reservoir.

4. The control valve assembly of claim 2, wherein the valve core has a first flow divider that is aligned with a second flow divider provided in the valve body.

5. The control valve assembly of claim 1, wherein the valve body is integral with a housing having a separating wall that defines, on one side thereof, a liquid chamber, and defines, on an opposite side thereof, the reservoir containing the additive.

6. The control valve assembly of claim 5, wherein the housing is provided with a movable lid.

7. The control valve assembly of claim 6, wherein the lid is connected to the housing by a hinge.

8. The control valve assembly of claim 6, wherein the lid includes a closure arrangement for locking the lid in a dosed position on the housing.

9. The control valve assembly of claim 1, wherein at least one of the first inlet port and the outlet port is provided with a quick connect adapter.

* * * * *